US005932063A

United States Patent [19]

Barnard, Jr.

[11] Patent Number: 5,932,063

[45] Date of Patent: Aug. 3, 1999

[54] VACUUM POWERED CORSAGE CREATING SYSTEM

[76] Inventor: Dan D Barnard, Jr., 700 S. 12th St., Frederick, Okla. 73542

[21] Appl. No.: 09/078,631

[22] Filed: May 14, 1998

[51] Int. Cl.[6] ..... A41G 1/02

[52] U.S. Cl. ..... 156/443; 428/24; 493/957

[58] Field of Search ..... 493/955, 956, 493/957, 379; 156/61, 474, 148, 443; 428/24, 25, 26, 4, 5

[56] References Cited

U.S. PATENT DOCUMENTS 4,291,496 9/1981 Click ..... 428/24 X 5,300,010 4/1994 Eddins ..... 493/379

5,545,274 8/1996 Rosenthal ..... 428/24 X

*Primary Examiner*—Joseph J. Hail, III

*Assistant Examiner*—Anthony Ojini

[57] ABSTRACT

A new Vacuum Powered Corsage Creating System for facilitating production of corsages and enhances appearance of the puffy effect. The inventive device includes a base having a cavity, a vacuum device, a first member, a second member, and a third member wherein the first member is pivotally attached to the base.

8 Claims, 4 Drawing Sheets

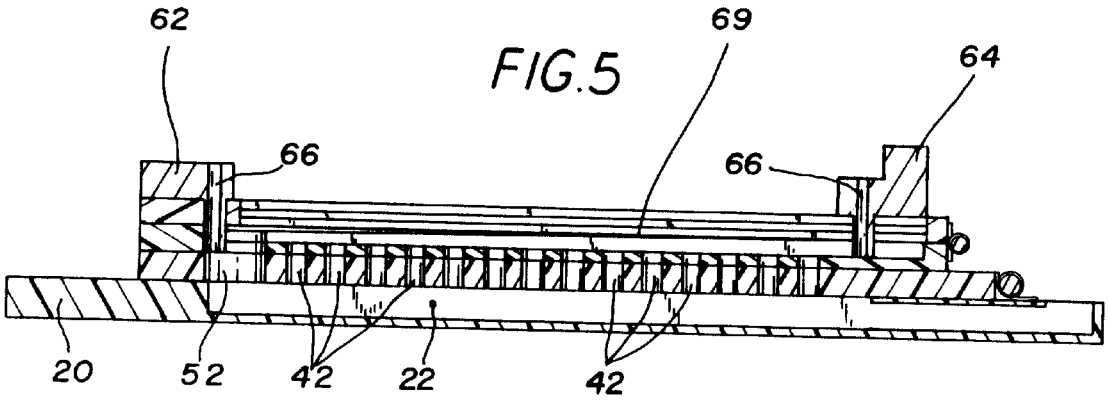
FIG. 5
FIG. 6
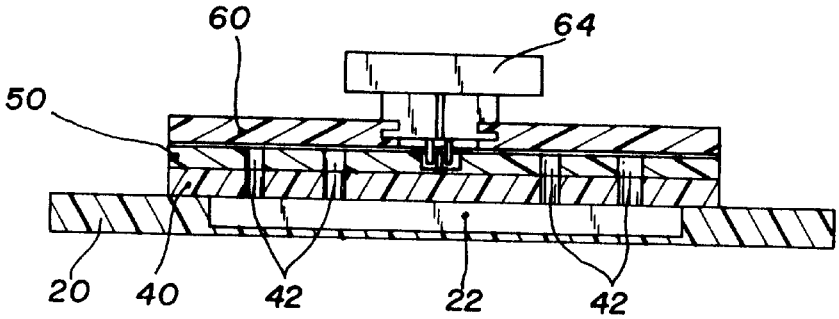

VACUUM POWERED CORSAGE CREATING SYSTEM

BACKGROUND OF THE INVENTION

1. Field of the Invention

The present invention relates to Artificial Flower Creating Devices and more particularly pertains to a new Vacuum Powered Corsage Creating System for facilitating production of corsages and enhances appearance of the puffy effect.

2. Description of the Prior Art

The use of Artificial Flower Creating Devices is known in the prior art. More specifically, Artificial Flower Creating Devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art Artificial Flower Creating Devices include U.S. Pat. No. 5,236,748; U.S. Pat. No. 4,892,515; U.S. Pat. No. Des. 360,379; U.S. Pat. No. 5,300,010; U.S. Pat. No. 4,708,893; and U.S. Pat. No. 4,708,892.

While these devices fulfill their respective, particular objectives and requirements, the aforementioned patents do not disclose a new Vacuum Powered Corsage Creating System. The inventive device includes a base having a cavity, a vacuum device, a first member, a second member, and a third member wherein the first member is pivotally attached to the base.

In these respects, the Vacuum Powered Corsage Creating System according to the present invention substantially departs from the conventional concepts and designs of the prior art, and in so doing provides an apparatus primarily developed for the purpose of facilitating production of corsages and enhances appearance of the puffy effect.

SUMMARY OF THE INVENTION

In view of the foregoing disadvantages inherent in the known types of Artificial Flower Creating Devices now present in the prior art, the present invention provides a new Vacuum Powered Corsage Creating System construction wherein the same can be utilized for facilitating production of corsages and enhances appearance of the puffy effect.

The general purpose of the present invention, which will be described subsequently in greater detail, is to provide a new Vacuum Powered Corsage Creating System apparatus and method which has many of the advantages of the Artificial Flower Creating Devices mentioned heretofore and many novel features that result in a new Vacuum Powered Corsage Creating System which is not anticipated, rendered obvious, suggested, or even implied by any of the prior art Artificial Flower Creating Devices, either alone or in any combination thereof.

To attain this, the present invention generally comprises a base having a cavity, a vacuum device, a first member, a second member, and a third member wherein the first member is pivotally attached to the base.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new Vacuum Powered Corsage Creating System apparatus and method which has many of the advantages of the Artificial Flower Creating Devices mentioned heretofore and many novel features that result in a new Vacuum Powered Corsage Creating System which is not anticipated, rendered obvious, suggested, or even implied by any of the prior art Artificial Flower Creating Devices, either alone or in any combination thereof.

It is another object of the present invention to provide a new Vacuum Powered Corsage Creating System which may be easily and efficiently manufactured and marketed.

It is a further object of the present invention to provide a new Vacuum Powered Corsage Creating System which is of a durable and reliable construction.

An even further object of the present invention is to provide a new Vacuum Powered Corsage Creating System which is susceptible of a low cost of manufacture with regard to both materials and labor, and which accordingly is then susceptible of low prices of sale to the consuming public, thereby making such Vacuum Powered Corsage Creating System economically available to the buying public.

Still yet another object of the present invention is to provide a new Vacuum Powered Corsage Creating System which provides in the apparatuses and methods of the prior art some of the advantages thereof, while simultaneously overcoming some of the disadvantages normally associated therewith.

Still another object of the present invention is to provide a new Vacuum Powered Corsage Creating System for facilitating production of corsages and enhances appearance of the puffy effect.

Yet another object of the present invention is to provide a new Vacuum Powered Corsage Creating System which includes a base having a cavity, a vacuum device, a first member, a second member, and a third member wherein the first member is pivotally attached to the base.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 5 is a cross sectional view taken along line 5—5 of FIG. 2.

FIG. 6 is a cross sectional view taken along line 6—6 of FIG. 2.

DESCRIPTION OF THE PREFERRED EMBODIMENT

Figure 1:
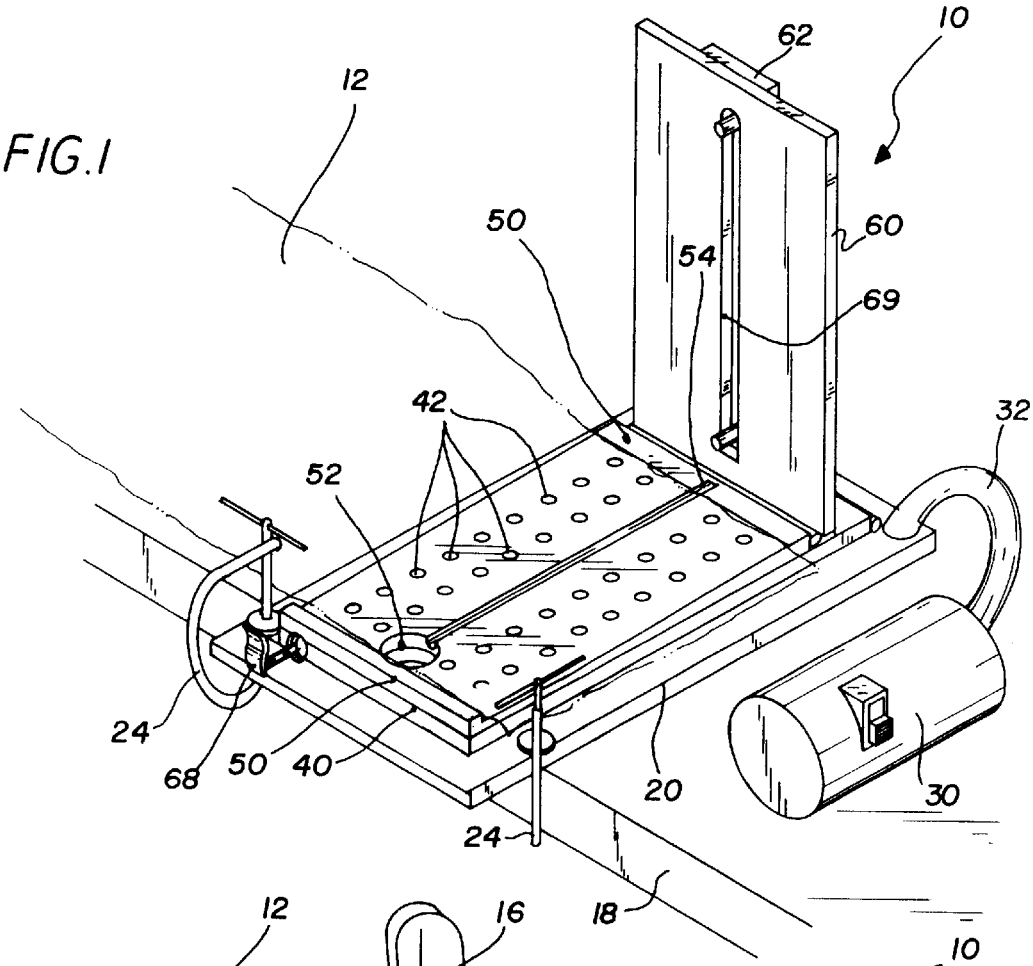
FIG. 1 is an upper perspective view of a new Vacuum Powered Corsage Creating System according to the present invention.

With reference now to the drawings, and in particular to FIGS. 1 through 8 thereof, a new Vacuum Powered Corsage Creating System embodying the principles and concepts of the present invention and generally designated by the reference numeral 10 will be described.

Figure 2:
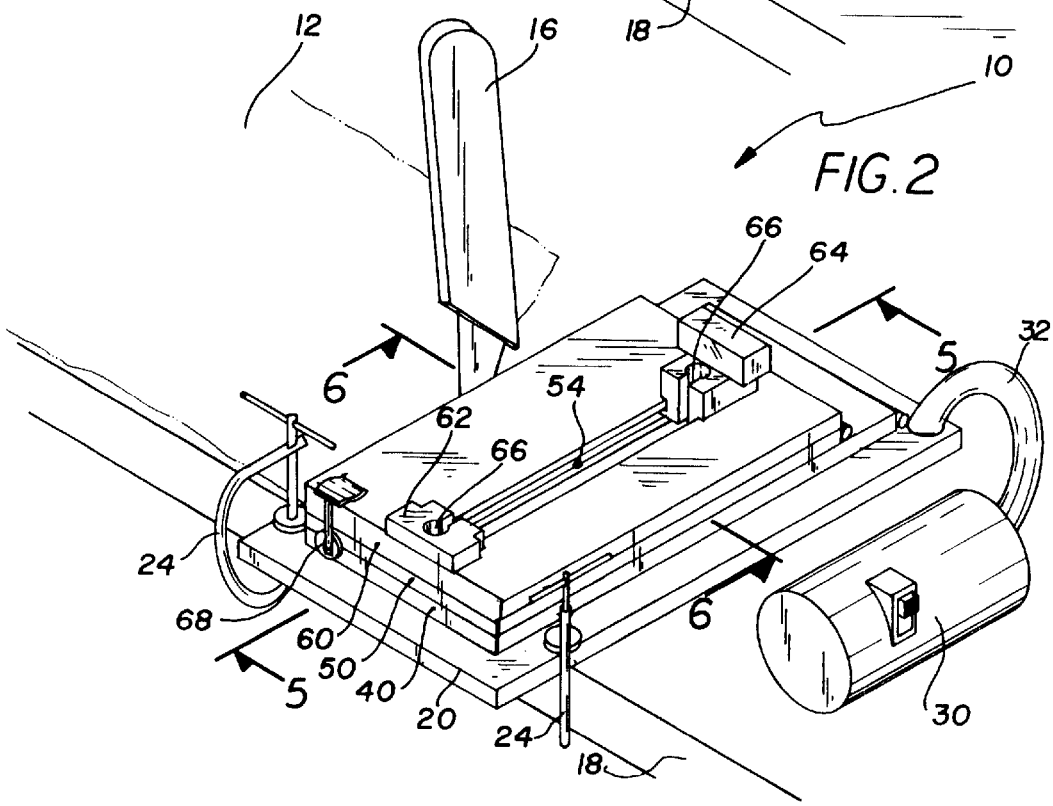
FIG. 2 is an upper perspective view of the present invention.
Figure 3:
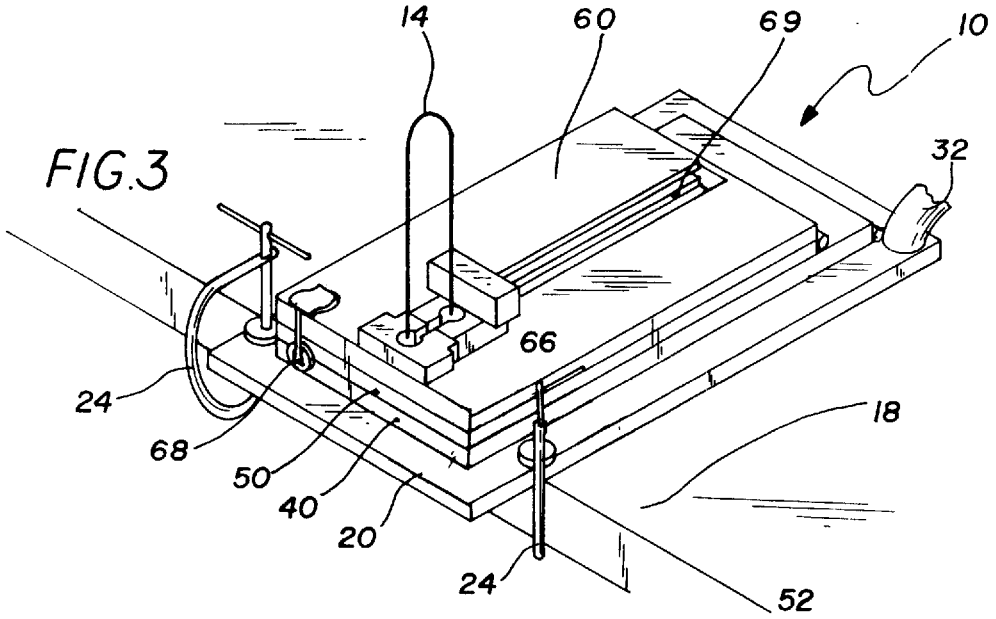
FIG. 3 is an upper perspective view of the present invention.
Figure 4:
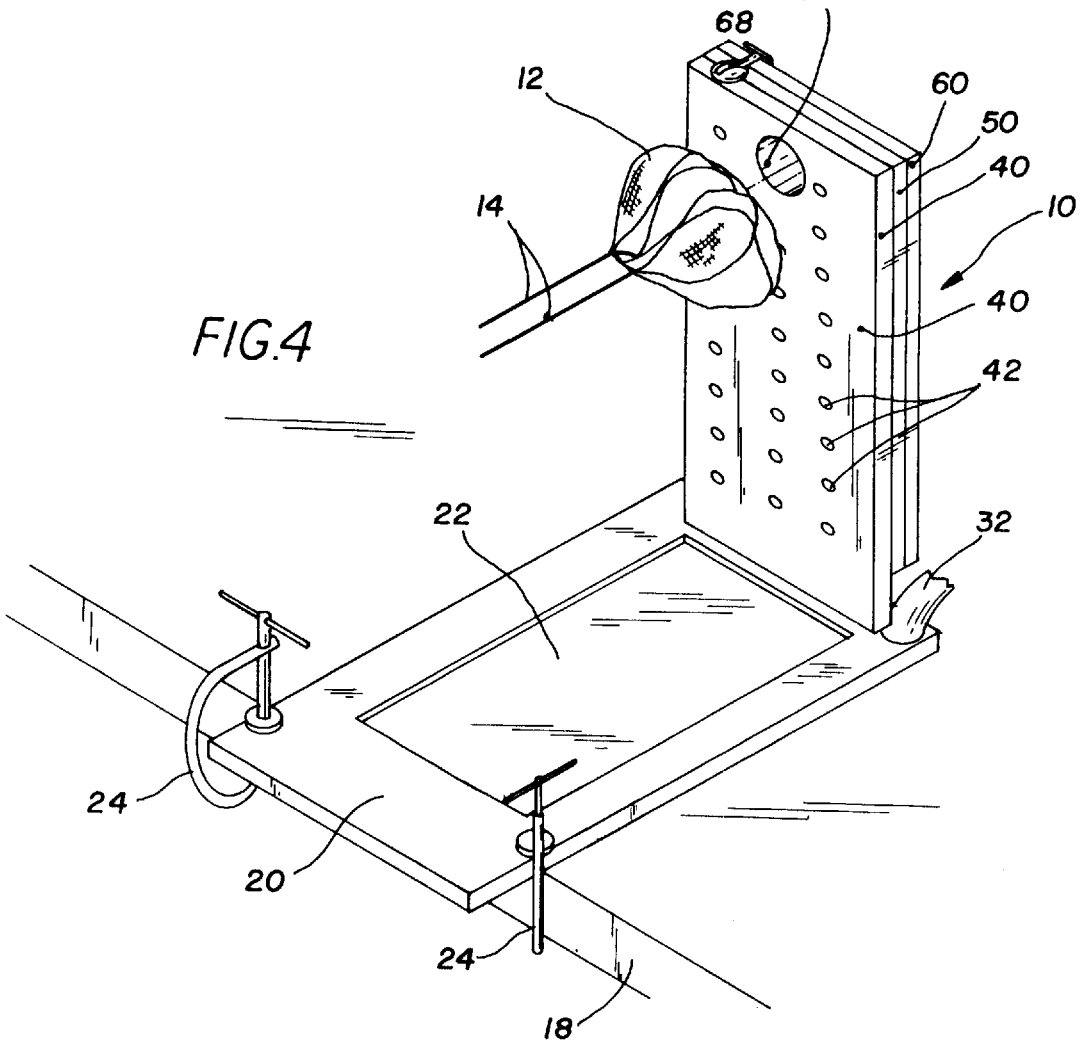
FIG. 4 is an upper perspective view of the present invention.

As best illustrated in FIGS. 1 through 8, the Vacuum Powered Corsage Creating System 10 comprises a base 20 having a cavity 22 projecting into a top surface. A vacuum device 30 is connected to the base 20 by a hose 32 and fluidly connected to the cavity 22 for creating a vacuum within the cavity 22 when sealed. A first member 40 is formed for enclosing and sealing the cavity 22 and pivotally attached to the base 20 at one end thereof. A second member 50 is provided and has a groove 54 along a longitudinal axis. The second member 50 is pivotally attached to the first member 40 for being juxtaposedly positionable to the first member 40. A third member 60 having a slot 69 along a longitudinal axis is pivotally attached to the first member 40 for being juxtaposedly positionable to the second member 50. A corsage material 12 is positionable mesial the third member 60 and the second member 50 as shown in FIG. 1 of the drawings. A wire 14 is slidably positionable within the slot 69 and the groove 54 around the corsage material 12 as shown in FIG. 3 of the drawings. A plurality of vacuum apertures 42 project through the first member 40 and the second member 50 correspondingly as shown in FIGS. 1, 4, 5 and 6 of the drawings. A receiving aperture 52 projects through the first member 40 and the second member 50 and is connected to the slot 69 and the groove 54 as shown in FIGS. 1, 4 and 5 of the drawings.

As shown in FIGS. 2, 3 and 5 of the drawings, a secured member 62 projects within the slot 69 of the third member 60 above the receiving aperture 52. A sliding member 64 is slidably positioned within the slot 69 of the third member 60 for allowing a user to push an end of the wire 14 towards an opposite end thereof with the corsage material 12 mesial both of send ends of the wire 14 as best shown in FIG. 3 of the drawings. The secured member 62 and the sliding member 64 preferably have a notch 66 for receiving the wire 14.

As shown in FIGS. 2 through 4 of the drawings, a latch 68 is secured to the third member 60 and the first member 40 for securing the third member 60 and the first member 40 together. At least one clamp 24 is provided for securing the base 20 to a table 18 as shown in FIGS. 1 through 4 of the drawings.

Figure 7:
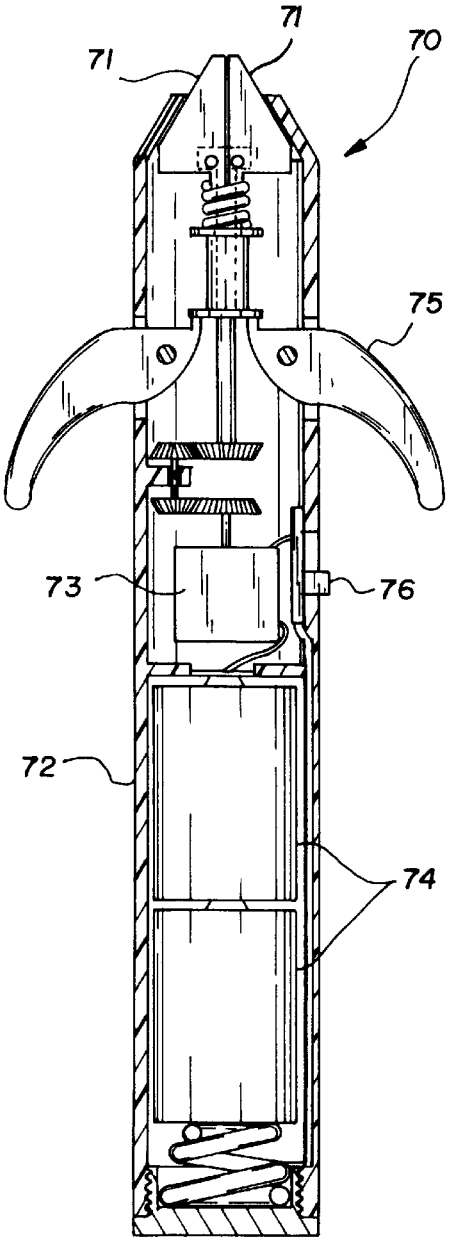
FIG. 7 is a sectional view of a battery powered pinching device with rotatable pinching jaws.
Figure 8:
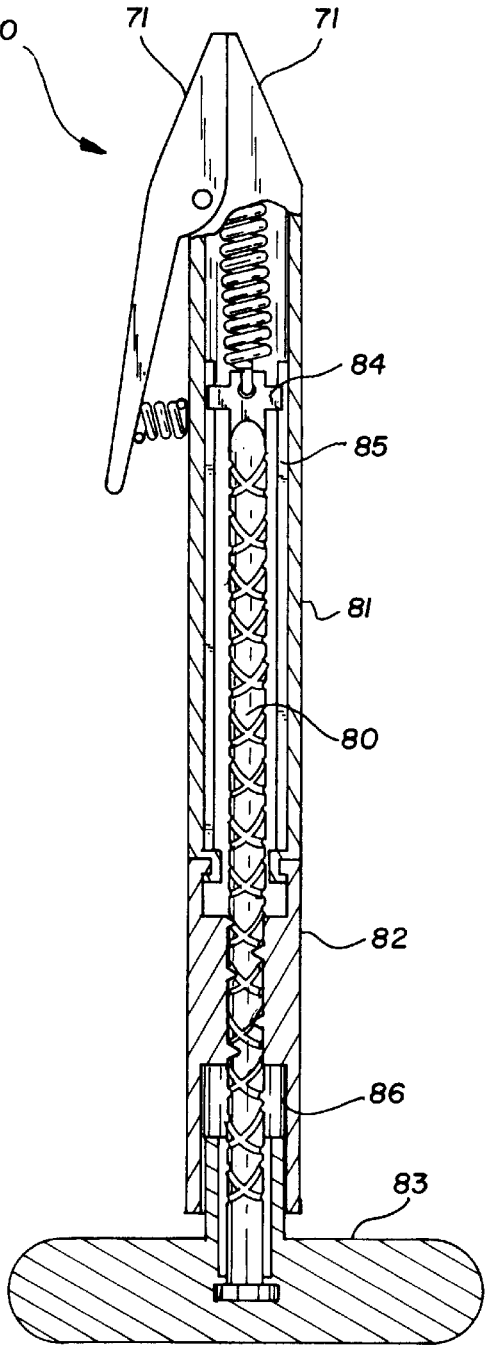
FIG. 8 is a sectional view of a hand-operated pinching device.

Preferably, as illustrated in FIGS. 7 and 8, the Vacuum Powered Corsage Creating System 10 further includes a pinching means 70 for manipulating the wire 14. Ideally, the pinching means 70 includes a pair of pinching jaws 71 rotatably attached to a main body member 72. At least one lever 75 is squeezed to open the pinching jaws 71. As shown in FIG. 7, the pinching jaws 71 may be rotated with respect to the main body member 72 by means of an electric motor 73 powered by batteries 74 or other suitable power source. In such an embodiment, an electrical switch 76 controls the flow of electricity to the electric motor 73.

Alternatively, as shown in FIG. 8, the pinching jaws 71 may be nonrotatably coupled to a rotating body portion 81 which is rotated with respect to a stationary body portion 82 by manipulating a threaded shaft 80. A slide member 84 is attached to one end of the threaded shaft 80. The slide member 84 slides along a slide groove 85 extending along the rotating body portion 81. A handle 83 is rotatably attached to the other side of the threaded shaft 80. A threaded sleeve 87 is coupled to the stationary body portion 82 to engage the threaded shaft 80. In use, a user places one hand on the stationary body portion 82 and pulls the handle 83 away from the stationary body portion 82 with the other hand, thereby causing the threaded shaft 80 to rotate as it slides along the threaded sleeve 86. As the threaded shaft 80 rotates, so does the slide member 84 coupled to it, which in turn causes the rotating body portion 81 to rotate.

In use, the corsage material 12 is positioned mesial the second member 50 and the third member 60 as shown in FIG. 1 of the drawings. The user utilizes a knife 16 or similar sharp object to cut the corsage material 12 to the proper length as shown in FIG. 2 of the drawings. As shown in FIG. 3 of the drawings, the third member 60 is positioned juxtaposed to the corsage material 12 and the latch 68 is closed thereby securing the corsage material 12 within. The first member 40 is pivoted juxtaposed to said base 20 as shown in FIG. 3 of the drawings, and the wire 14 is inserted into the groove 53 through the notches 66 within the secured member 62 and the sliding member 64. The vacuum device 30 is activated thereby creating a vacuum within the cavity 22 and the vacuum apertures 42 thereby pulling the corsage material 12 downwardly into the vacuum apertures 42. The sliding member 64 is slid towards said secured member 62 thereby positioning apposite ends of the wire 14 adjacent one another. The vacuum device 30 is deactivated and the first member 40 is pivoted upward away from said base 20 as shown in FIG. 4 of the drawings. The user then pulls the wire 14 through the receiving aperture 52 along with the crinkled corsage material 12 as shown in FIG. 4 of the drawings. The user thereafter manipulates the wire 14 and the crinkled corsage material 12 to the desired design. Preferably, the user would utilize the pinching means 70 by grasping the ends of the wire 14 with the pinching jaws 71 and then cause the pinching jaws 71 to rotate, causing the wire ends to twist together.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A vacuum powered corsage creating system for facilitating production of corsages and enhances appearance of the puffy effect of said corsages, comprising:

a base having a cavity projecting into a top surface;

a vacuum device connected to said base by a hose and fluidly connected to said cavity for creating a vacuum within said cavity when scaled;

a first member formed for enclosing and sealing said cavity and pivotally attached to said base at one end thereof;

a second member having a groove along a longitudinal axis and pivotally attached to said first member for being juxtaposedly positionable to said first member;

a third member having a slot along a longitudinal axis and pivotally attached to said first member for being juxtaposedly positionable to said second member, wherein a corsage material is positionable mesial said third member and said second member and wherein a wire is slidably positionable within said slot and said groove around said corsage material;

a plurality of vacuum apertures project through said first member and said second member correspondingly; and a receiving aperture projecting through said first member and said second member connected to said slot and said groove.

2. The vacuum powered corsage creating system of claim 1, including a secured member projecting within said slot of said third member above said receiving aperture and a sliding member slidably positioned within said slot of said third member for allowing a user to push an end of said wire towards an opposite end thereof with said corsage material mesial both of said ends of said wire.

3. The vacuum powered corsage creating system of claim 2, wherein said secured member and said sliding member include a notch for receiving said wire.

4. The vacuum powered corsage creating system of claim 3, including a latch secured to said third member and said first member for securing said third member and said first member together.

5. The vacuum powered corsage creating system of claim 4, including at least one clamp for securing said base to a table.

6. The vacuum powered corsage creating system of claim 5, including a pinching means for manipulating said wire.

7. The vacuum powered corsage creating system of claim 6, wherein said pinching means includes a pair of pinching jaws rotatably attached to a main body member, said pinching jaws being for grasping said ends of said wire and twisting said wire ends together.

8. The vacuum powered corsage creating system of claim 3, including a pinching means for manipulating said wire.

* * * * *